US008635826B2

(12) United States Patent
Pfeiffer

(10) Patent No.: US 8,635,826 B2
(45) Date of Patent: Jan. 28, 2014

(54) INSULATION INSERT PANEL FOR USE WITH INSULATING CONCRETE FORM (ICF) SYSTEMS

(75) Inventor: Henry E. Pfeiffer, Omaha, NE (US)

(73) Assignee: Reward Wall Systems, Inc., Omaha, NE (US)

( * ) Notice: Subject to any disclaimer, the term of this patent is extended or adjusted under 35 U.S.C. 154(b) by 105 days.

(21) Appl. No.: 13/443,529

(22) Filed: Apr. 10, 2012

(65) Prior Publication Data

US 2013/0263544 A1 Oct. 10, 2013

(51) Int. Cl.
*E04B 1/80* (2006.01)
*E04B 1/76* (2006.01)

(52) U.S. Cl.
CPC ..... *E04B 1/7608* (2013.01)
USPC ..... 52/405.3; 52/405.4; 52/404.2; 52/404.5; 52/426; 52/428; 52/442

(58) Field of Classification Search
USPC ..... 52/404.2, 404.3, 404.5, 405.1–405.4, 52/407.3, 426, 428, 442
See application file for complete search history.

(56) References Cited

U.S. PATENT DOCUMENTS

| | | | | | |
|---|---|---|---|---|---|
| 2,199,112 | A * | 4/1940 | O'Leary | ..... | 52/405.2 |
| 3,546,833 | A * | 12/1970 | Perreton | ..... | 52/405.3 |
| 3,704,562 | A * | 12/1972 | Grants | ..... | 52/405.1 |
| 3,885,363 | A * | 5/1975 | Whittey | ..... | 52/405.1 |
| 4,348,845 | A * | 9/1982 | Iannarelli | ..... | 52/405.3 |
| 4,655,014 | A * | 4/1987 | Krecke | ..... | 52/426 |
| 5,065,561 | A * | 11/1991 | Mason | ..... | 52/426 |
| 6,820,384 | B1 * | 11/2004 | Pfeiffer | ..... | 52/426 |

FOREIGN PATENT DOCUMENTS

DE 19548440 A1 4/1997

OTHER PUBLICATIONS

The Fox Blocks Energy Stick, Copyright 2012 Fox Blocks.

* cited by examiner

*Primary Examiner* — Mark Wendell
*Assistant Examiner* — Matthew J Smith
(74) *Attorney, Agent, or Firm* — Husch Blackwell LLP; Samuel Digirolamo

(57) ABSTRACT

An insulation insert panel for use with an ICF block having a pair of opposed panel members and a plurality of tie members extending transversely therebetween, the insert panel including a plurality of spaced apart slots extending along the length thereof for mating with the tie members associated with the ICF block into which it is being inserted, each slot including at least one notch located in the vicinity of its terminal end portion for receiving at least one crossbar member associated with each tie member when the insert panel is fully positioned within the ICF block.

16 Claims, 4 Drawing Sheets

INSULATION INSERT PANEL FOR USE WITH INSULATING CONCRETE FORM (ICF) SYSTEMS

BACKGROUND OF INVENTION

The present invention relates generally to insulating concrete form (ICF) systems and, more particularly, to an insulation insert panel which can used in conjunction with ICF systems to increase and/or improve the insulation capability of the concrete wall being formed by the ICF system.

Insulating concrete form (ICF) systems are well-known in the industry and are commonly used to form wall systems in both residential and commercial structures. Such systems utilize a plurality of individual blocks aligned horizontally and vertically in an interlocking arrangement to create forms for concrete walls. Each ICF block includes a pair of foamed panels which are retained in a spaced-apart relationship parallel to each other by a plurality of tie members. The ICF blocks serve to contain fluid concrete while it solidifies and also provides insulation for the finished wall structure.

The spacing tie members in each ICF block are truss-like in structure and include opposing flange portions which typically reside within the respective opposing foam panels forming a particular ICF block. The opposing flange portions are separated by an intermediate web portion connected therebetween, enabling the tie member to hold and secure the panel portions. The web portion includes a pair of substantially identical transverse bridge members for providing centralized structural support within and along the entire ICF block. The ICF blocks as well as the associated tie members come in a variety of sizes depending upon the thickness of the concrete wall desired.

Although the pair of foam panels forming each respective ICF block provide added insulation to the concrete wall being formed on both opposite sides thereof, there are times when additional insulation or increased R-value is desired along an entire length of a particular wall, along a portion of a particular wall, or at specified locations along a particular wall section.

It is therefore desirable to provide a mechanism for improving or increasing the insulation capability associated with a particular ICF system without changing the structure of the ICF blocks or without redesigning the ICF system currently in use.

Accordingly, the present invention is designed to allow a user of a particular ICF system to add additional insulation capability to a particular wall or wall section under construction without changing or redesigning the particular ICF blocks being used to form that particular wall structure.

SUMMARY OF INVENTION

The present invention relates to an insulation insert panel that can be easily positioned along the length of an ICF block adjacent the interior surface of one of the panels forming the ICF block so as to improve or increase the insulation capability associated with that particular ICF block. The present insulation insert panel includes a plurality of slots positioned and located along the length of the insulation panel, the slots being positioned and located so as to be in alignment with the respective plurality of ties associated with that particular ICF block when the present insulation panel is positioned for engagement with the ICF block. Each slot or gap extends from adjacent the bottom edge portion of each respective insulation insert panel to a predetermined location short of the top edge portion of each insert panel. Each slot or gap is sufficiently wide so as to allow the intermediate web structure of each respective tie member to pass therethrough as the present insulation panel is slidably positioned into its operative position. The bottom edge portions of each respective slot is tapered or beveled so as to guide the slot or gap over the reinforcing crossbar members associated with the web portion of each respective tie member.

The terminal end portion of each respective slot includes a pair of spaced apart notches which are positioned and located so as to receive and engage the projecting crossbar member associated with each opposite side of the transverse bridge member associated with the upper portion of each respective tie member. In this regard, the pair of notches are specifically positioned and located so as to engage the reinforcing crossbar members of the tie members associated with the Reward Wall Systems, Inc. (Reward Wall) iForm ICF system as will be hereinafter further explained. The second notch is positioned and located so as to engage certain tie members associated with certain Reward Wall iForm ICF blocks wherein the respective bridge members each include a pair of reinforcing crossbar members. When the present insulation insert panel is positioned adjacent the inner surface of one of the ICF block panels, the projecting reinforcing crossbar members associated with each respective web bridge member is engaged with one or both notches associated with the upper portion of each respective slot so as to lock the insert panel into proper position within the particular ICF block into which it is inserted. This insures a tight, stable engagement with the respective tie members when the present insulation insert panel is properly positioned inside a particular ICF block and prevents movement during pouring of the concrete into the respective ICF blocks.

The present insulation insert member is typically made of an expanded polystyrene material or any other suitable material, and it can be coated with graphite or other materials in order to increase its R-value. The density of the polystyrene associated with forming each respective insulation insert panel can likewise be changed and/or varied so as to increase or decrease the R-value associated with each respective panel. The insulation insert panels are typically sized in height and length so as to correspond to the height and length of each respective panel member making up a particular ICF block. This allows a user to cover the entire inner surface of one of the ICF block panels with a single insert panel. It is also recognized and anticipated that the height and length of each of the present insulation insert panels can be varied so as to cover any portion or section of a particular ICF block and they can be made in varying thicknesses.

The present insulation insert panel is typically positioned adjacent the inside surface of the particular ICF block panel that faces the outside portion of the wall structure to be formed. This allows additional insulation to be located between the outside face of the concrete wall to be formed and the outside wall surface thereby providing greater insulation between the outside surface of the wall structure and the temperatures associated with the outside environment.

The top and bottom surfaces of each respective insulation insert panel may likewise include cooperatively engageable means for cooperatively engaging one insulation insert panel with another insulation insert panel when vertically stacked one upon the other within vertically stacked ICF blocks. In this regard, one of the top and bottom surfaces may include a longitudinally extending groove configured so as to cooperatively receive a corresponding longitudinally extending projection associated with the opposite end portion thereof. Although optional, this cooperatively engageable arrangement allows the top of one of the present insulation insert panels to cooperatively accept and receive the bottom of the next insert panel when stacked one above the other and such an arrangement further helps to eliminate movement of the respective insert panels during pouring of the concrete within each respective ICF block. It is recognized and anticipated that other cooperatively engageable means can likewise be utilized, if necessary, to cooperatively engage a plurality of the present insulation insert panels when they are stacked one upon the other inside a plurality of stacked ICF blocks to form a particular wall structure.

These and other objects of the present invention will become more apparent to those skilled in the art after considering the following detailed specification taken in conjunction with the accompanying drawings.

DETAILED DESCRIPTION

Figure 1:
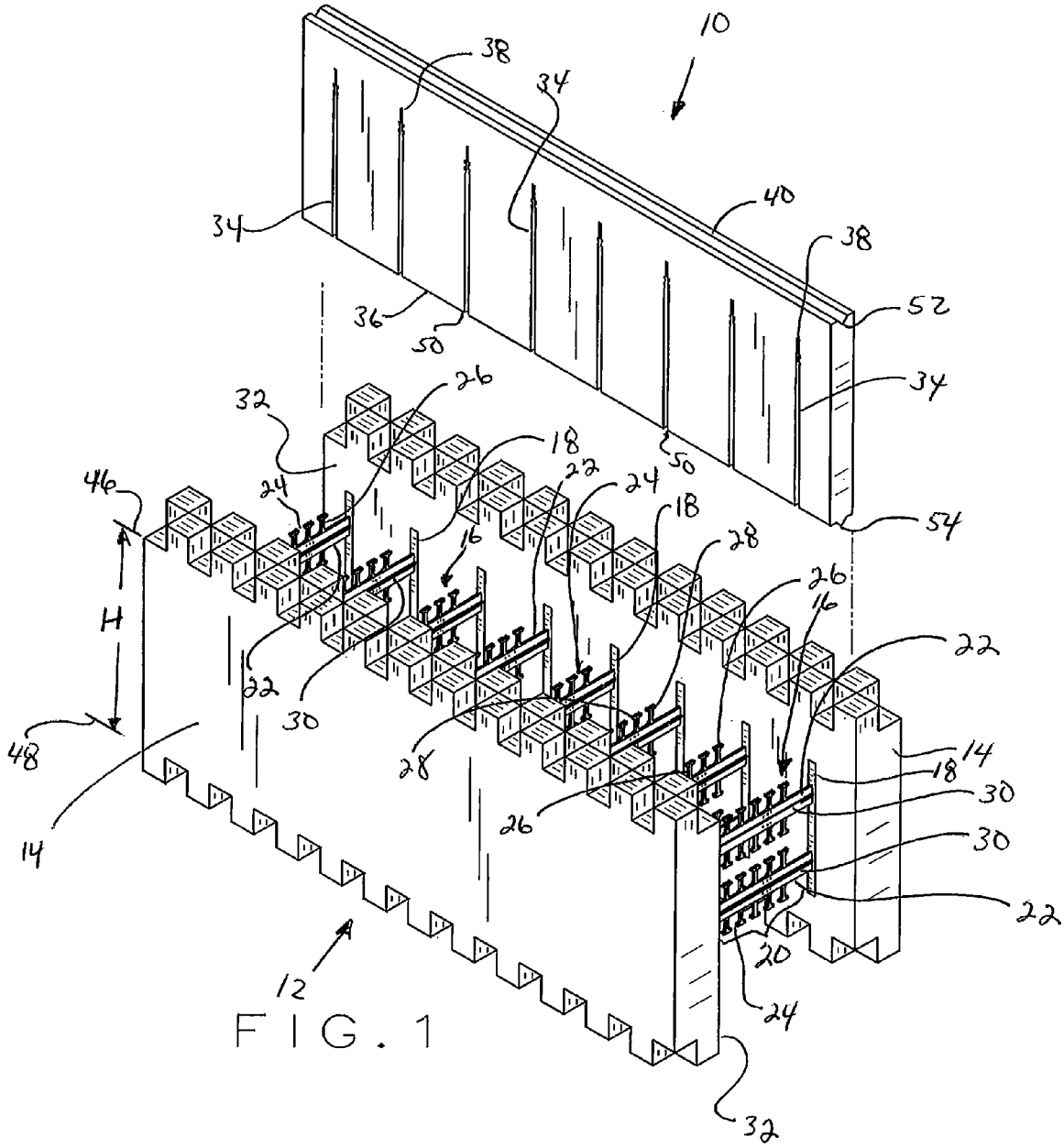
FIG. 1 is an exploded perspective view showing one embodiment of the present insulation insert panel positioned for engagement with a particular ICF block.
Figure 2:
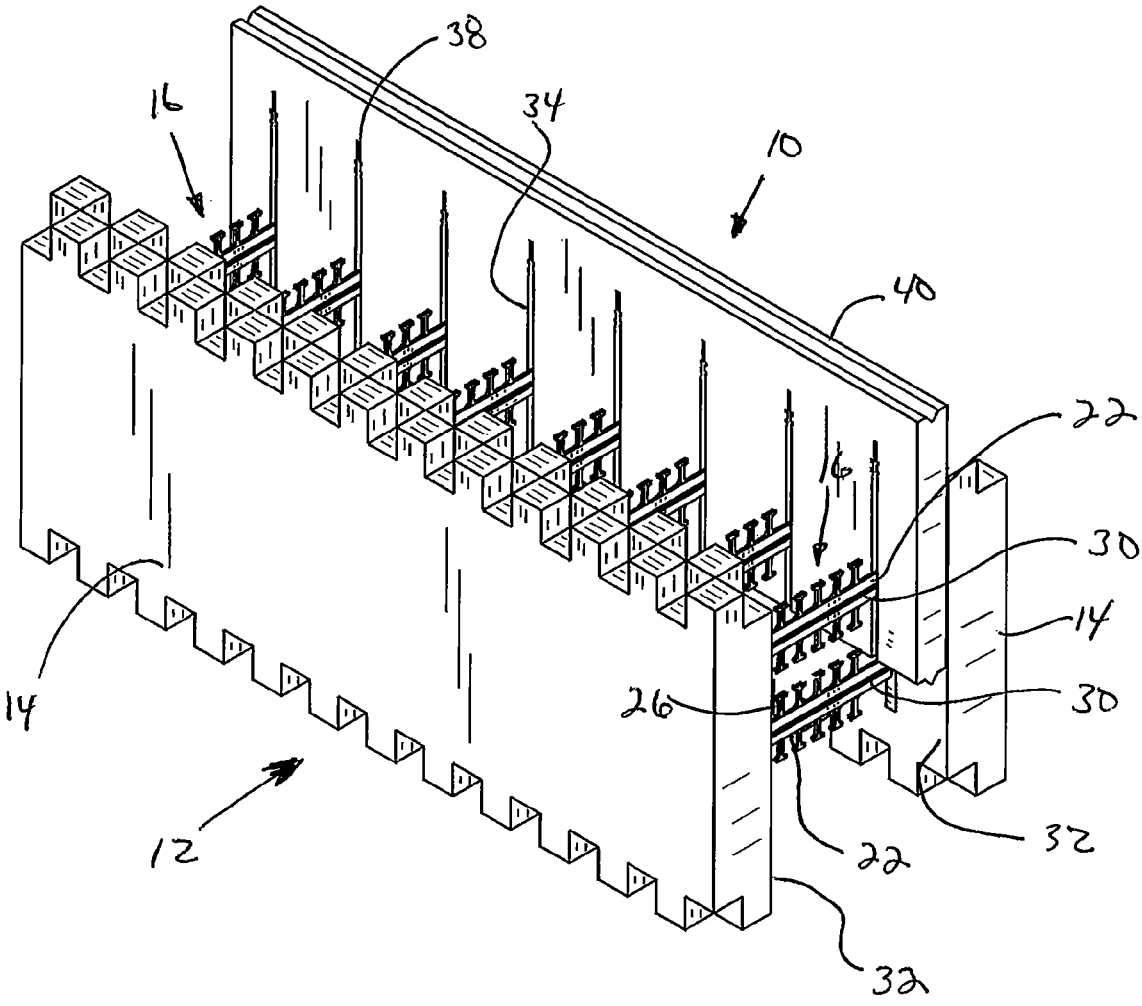
FIG. 2 is a perspective view similar to FIG. 1 showing the present insulation insert panel partially engaged with a particular ICF block.
Figure 3:
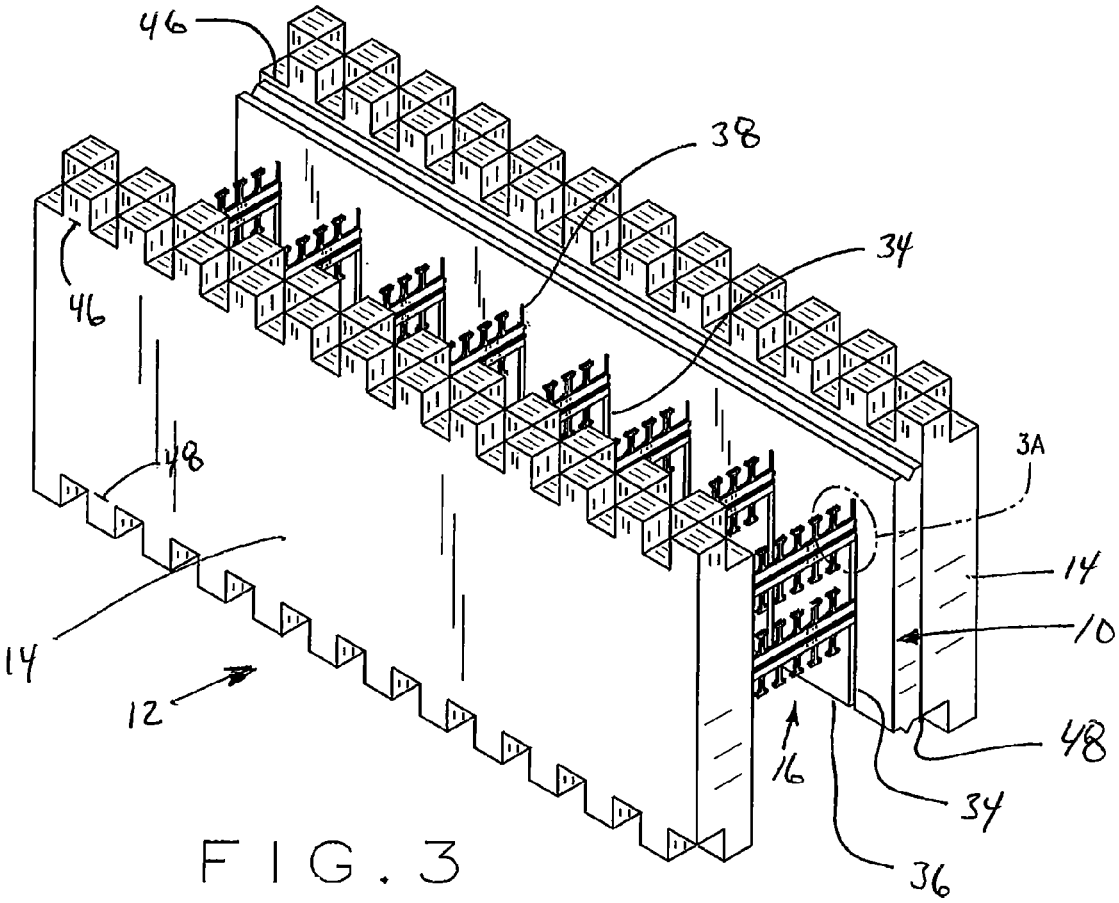
FIG. 3 is a perspective view similar to FIG. 2 showing the present insulation insert panel fully engaged adjacent the interior surface of one of the ICF block panels.

Referring to the drawings more particularly by reference numbers wherein like numerals refer to like parts, the numeral 10 in FIGS. 1-7 identifies one embodiment of an insulation insert panel member constructed according to the teachings of the present invention. The present insulation insert panel member 10 is specifically designed to be installed on any of the current iForm ICF blocks manufactured by Reward Wall Systems, Inc. of Omaha, Nebr. and, particularly, the iForm ICF blocks utilizing six inch, eight inch, ten inch and twelve inch Reward Wall tie members. FIGS. 1-3 illustrate a simplified version of a typical iForm ICF block and tie member structure manufactured by Reward Wall Systems, Inc. The ICF block 12 illustrated in FIGS. 1-3 includes a pair of parallel opposing panel members 14 retained in spaced apart relationship to each other by a plurality of tie members 16. The tie members 16 each include a pair of flange members 18 separated by, and connected to a web portion 20. The web portion 20 includes a pair of opposing truss members (not shown) connected by a pair of substantially identical transverse bridge members 22 each having a plurality of rebar retaining seats 24 associated therewith. In one embodiment, the tie members 16 are constructed from polypropylene. In other embodiments, the tie members can be constructed of metal, or other suitable materials.

The rebar seats 24 are substantially identical to each other in configuration and are arranged in a pair of opposing rows along each transverse bridge member 22. Each rebar seat 24 is of a substantially U-shaped well formed by a pair of adjacent fingers 26. Each rebar seat 24 is capable of retaining at least one rebar rod positioned therein. An inwardly extending lateral knuckle or projection 28 is formed in either or both distal ends of adjacent fingers 26 creating a distance between opposing projections 28 that is substantially less than the lateral distance between the proximal ends of adjacent fingers 26. The knuckles or projections 28 serve to help retain the rebar rod within each respective rebar seat 24.

In the embodiment illustrated in FIGS. 1-3, the transverse bridge members 22 each include a projecting reinforcing crossbar member 30 on each opposite side thereof which adds additional structure and stability to each bridge member 22 as well as to the overall web portion 20. As can be clearly seen in FIGS. 1-3, the plurality of tie members 16 extend transversely between opposing inner surfaces 32 of the opposing block panels 14. In addition, the opposing flanges 18 and the trusses (not shown) of each tie member 16 are substantially retainably encapsulated within each respective opposing block panel 14 such that each flange member 18 is seated inwardly from the outer surface of each block panel 14 within which it is encapsulated.

In addition, cooperatively engageable means in the form of an array of alternating teeth and sockets are formed along the opposing horizontal longitudinal edges associated with each block panel 14 for removably attaching one ICF block 12 to other ICF blocks 12 having similar and complimentary engaging means associated therewith when such ICF blocks are vertically stackably arranged one on top of the other to form a particular wall structure. In the particular example illustrated in FIGS. 1-3, the array of alternating teeth and sockets includes two longitudinal rows of alternating teeth and sockets, the rows being offset from each other by the distance of one side of one tooth.

In similar fashion, the opposed vertical ends of each respective ICF block panel 14 likewise includes cooperatively engageable means in the form of an array of alternating teeth and sockets (not shown) for removably attaching one ICF block 12 to another ICF block 12 having similar and complimentary engaging means associated therewith when the ICF blocks 12 are placed in a side-by-side arrangement. For simplicity purposes, the vertical end wall engagement means are not illustrated in FIGS. 1-3.

The present insulation insert panel 10 as best illustrated in FIGS. 4-7 is preferably sized both lengthwise (L) and heightwise (H) so as to correspond to the length of each respective block panel 14 as well as to the height of each respective panel 14 as measured from the base of the array of alternating teeth and sockets associated with the top and bottom longitudinal horizontal edges of each respective panel member 14. This enables the present insert panel 10 to substantially identically align with the length and height of each respective ICF block panel 14 when the insert panel 10 is fully inserted and engaged within a respective ICF block as more clearly shown in FIG. 3. In this regard, it is recognized and anticipated that the overall length of each respective insert panel 10 can be varied so as to cover only a portion of a particular ICF block panel length depending upon the particular application, although the height of each respective insert panel 10 would generally remain the same so as to correspondingly match the height (H) of each respective ICF block as illustrated in FIG. 1. It is also recognized that the width or thickness of each respective insert panel can be varied depending upon the amount of additional insulation or R-value required for a particular installation.

Figure 4:
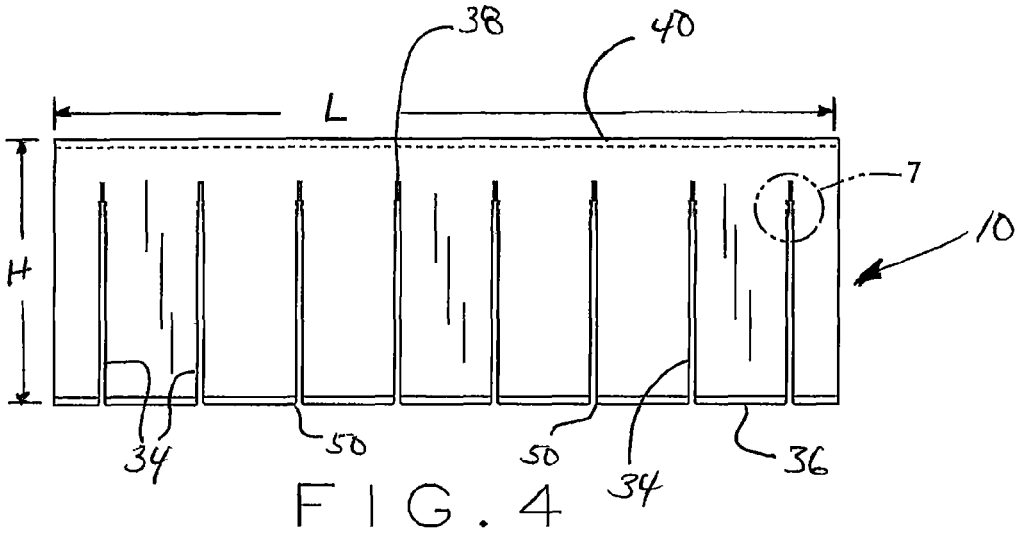
FIG. 4 is a side elevational view of one embodiment of the present insulation insert panel.

As best illustrated in FIG. 4, the present insulation insert panel 10 includes a plurality of spaced apart slots or gaps 34 which extend from the bottom edge portion 36 of insert panel 10 to a terminal end portion 38 which stops short of upper edge portion 40. The gaps or slots 34 are substantially vertical and are strategically positioned and located so as to align with each of the respective tie members 16 associated with a particular ICF block 12 as illustrated in FIGS. 1-3. Each respective slot or gap 34 is wide enough to receive all of the Reward Wall iForm ICF tie members associated with the various Reward Wall iForm ICF blocks including, particularly, the Reward Wall ICF blocks utilizing six inch, eight inch, ten inch and twelve inch tie members. Generally, a slot or gap 34 having a width in the neighborhood of approximately ⅜ inch would be sufficient to allow the web portion 20, the transverse bridge members 22, and the reinforcing projecting crossbar members 30 of each respective tie member 16 to pass therethrough. In this regard, the width of the respective slots 34 can be varied and adjusted depending upon the size of the particular tie member 16 and associated web portion 20 being utilized in a particular ICF block.

Figure 3A:
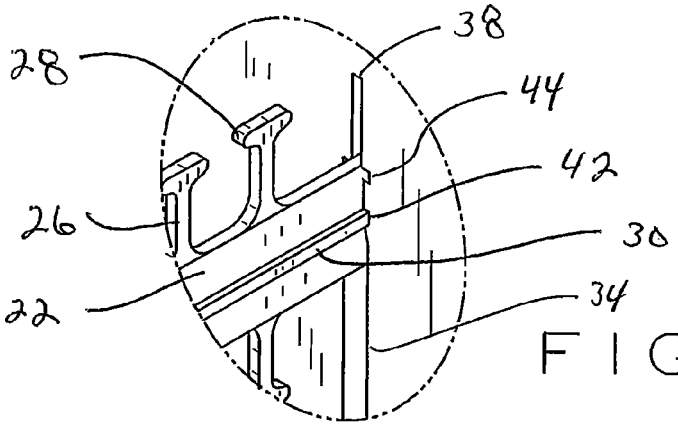
FIG. 3A is a partial exploded perspective view showing the projecting crossbar member associated with the web bridge member engaged with the first notch associated with one of the respective slots associated with the present insulation insert panel.
Figure 7:
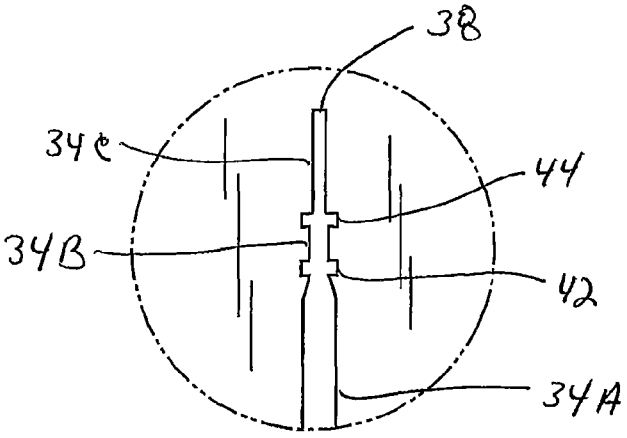
FIG. 7 is an enlarged exploded view of the terminal end portion of one of the respective slots associated with the present insulation panel member further illustrating the pair of notches associated therewith.

As best illustrated in FIG. 7, the upper end portion of each respective slot or gap 34 includes a pair of spaced apart notches 42 and 44 in the vicinity of the terminal end portion 38. In addition, the upper end portion of each slot 34 narrows from an original width of 34A to a narrower width 34B intermediate the respective notches 42 and 44, and to a still narrower width 34C adjacent its terminal end portion. The Reward Wall iForm four inch, six inch, eight inch and ten inch tie members all include a single projecting reinforcing crossbar member on each opposite side of the transverse bridge members 22 similar to the crossbar members 30 illustrated in FIGS. 1-3. Notch 42 is strategically positioned and located so as to receive this corresponding crossbar member 30 on both opposite sides of the upper bridge member 22 when the insulation insert panel 10 is fully engaged with and seated within a particular ICF block as best illustrated in FIG. 3. Crossbar members 30 associated with the Reward Wall four inch, six inch, eight inch and ten inch tie members are all located in substantially the same location on each respective transverse bridge member 22 and the slot 42 is sufficiently sized and dimensioned so as to fully receive and accept the crossbar members 30 associated with the upper transverse bridge member 22 of each of the respective tie members 16 associated with a particular ICF block 12. This engagement is best illustrated in FIG. 3A.

As illustrated in FIGS. 1-3, the insulation insert panel 10 is positioned above the particular ICF block into which it will be slidably inserted and adjacent the interior surface 34 of one of the ICF block panels 14 as best illustrated in FIG. 1. FIG. 2 shows the present insulation insert panel 10 partially inserted within a particular ICF block 14. As illustrated in FIG. 2, each respective gap or slot 34 has received the web portion 20 of each respective tie member 16 and the respective transverse bridge members 22 and any rebar seat fingers 26 located within the thickness of the insert panel 10. When the insert panel 10 is fully engaged and seated within a particular ICF block 14 as best illustrated in FIG. 3, the reinforcing crossbar members 30 are received within the first notch 42 as best illustrated in FIG. 3A. In this regard, the terminal end portion 34C of each respective slot 34 is of sufficient length to receive the upwardly extending rebar seat fingers 26 therewithin when the insert panel 10 is fully seated within a particular ICF block 14. Still further, when fully seated within the ICF block 14, the top and bottom edge portions 40 and 36 respectively of the insert panel 10 lie substantially flush with the respective base portions 46 and 48 associated with the particular ICF block as best illustrated in FIG. 3. This dimensional configuration allows for a clean, tight and integral connection between respective blocks as they are stackably arranged and interconnected one on top of the other to form a particular wall structure.

Since the Reward Wall iForm twelve inch tie member includes two spaced apart projecting reinforcing crossbar members similar to the single crossbar member 30 on each opposite side of the transverse bridge member 22 illustrated in FIGS. 1-3 and 3A, the second notch 44 associated with each respective slot 34 is positioned and located so as to receive and accept the second crossbar members (not shown) associated with the Reward Wall twelve inch ICF tie member. In this regard, when a twelve inch Reward Wall iForm tie member is utilized in a particular ICF block, both notches 42 and 44 will engage the pair of projecting reinforcing crossbar members associated with such tie member. When one or both crossbar members such as the crossbar member 30 illustrated in FIGS. 1-3 is received within one or both notches 42 and 44, the insulation insert panel 10 is locked into its proper position and will remain secure and stable adjacent the inner surface 34 of one of the ICF block panels 14 when concrete is poured within the respective ICF blocks. This engagement helps to secure the insert panel 10 within the ICF block from movement during pouring of the concrete.

Figure 5:
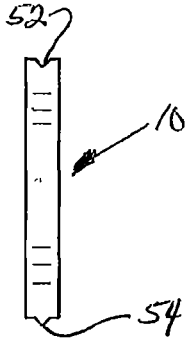
FIG. 5 is an end elevational view of the insert panel of FIG. 4.
Figure 6:
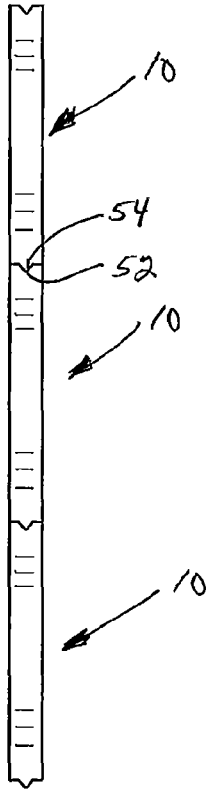
FIG. 6 is an end elevational view showing a plurality of the present insulation insert panels vertically stackably arranged one on top of the other.

The bottom edge portion of each respective slot 34 at each opposed end portion 50 (FIG. 4) is tapered or beveled so as to help guide the gap or slot 34 over the transverse bridge members 22 as the insert panel 10 is being slidably inserted within a particular ICF block 14. In addition, the top and bottom horizontal longitudinal edge surfaces 40 and 36 may each include cooperatively engageable means for removably engaging one insert panel 10 with another insert panel 10 when the present insert panels are vertically stackably arranged one on top of the other within a vertically stacked plurality of ICF blocks 14. In this regard, the top horizontal surface 40 may include a longitudinally extending groove 52 shaped and dimensioned to cooperatively receive a corresponding longitudinally extending projection 54 associated with the bottom edge portion 36 of each respective insert panel 10 as best illustrated in FIG. 5. FIG. 6 illustrates the respective engagement of the projection members 54 with the grooves 52 when a plurality of insulation insert panels 10 are vertically stackably arranged one on top of the other within a similarly stacked arrangement of ICF blocks 14 to form a particular wall structure. The grooves 52 and projections 54 likewise help to lock and stabilize the respective insert panels 10 within the corresponding ICF blocks 14 and help to prevent movement of such panels during the pouring of the concrete into the respective ICF blocks.

As previously explained, the present insulation insert panels 10 are used to increase and/or improve the insulation capability associated with a particular ICF system without changing the structure or width of the ICF blocks currently in use for a particular wall structure. As illustrated in FIG. 3, when the present insert panel 10 is fully seated within a particular ICF block, it affords additional insulation adjacent the concrete wall structure on that particular side of the ICF block. Typically, the insert panels 10 are positioned adjacent the outside wall of a particular wall structure so as to further protect the outside surface of the concrete wall from the outside environment including changes in temperature. As a result, each insert panel 10 adds additional insulation and R-value to that side of the particular wall structure. It is also recognized and anticipated that, depending upon the size of the particular concrete wall established by the particular ICF blocks in use, the present insulation insert panels 10 can be placed on one or both inside faces of a particular ICF block in order to achieve the desired insulation or R-value desired for a particular project. It is also recognized and anticipated that although only a substantially straight ICF block is illustrated in FIGS. 1-3, such blocks also come in a wide variety of different configurations including 90° corners, 45° corners, T-forms, taper tops, ledge forms, and still other configurations. The present insulation insert panel 10 can be shaped and configured to accommodate any of these different ICF block form configurations.

The present insulation insert panel 10 can be made of expanded polystyrene, or any other suitable insulation type material. In addition, the density of the polystyrene associated with each respective insert panel 10 can be changed and/or varied to achieve a specific R-value. Still further, other materials can be added to the polystyrene to likewise change the R-value associated with a particular insert panel 10, and the panels 10 can be coated with graphite or other materials to likewise increase the insulation capability and R-value of that particular panel. Polystyrene coated with graphite can likewise be used to achieve this goal. It is also recognized and anticipated that still other materials may be utilized to achieve the insulation capabilities desired, and the overall dimensions of the present insert panel 10 as well as its specific shape are also subject to wide variations and may be sized and shaped into a wide variety of different sizes and configurations so as to be compatible with the size and shape of a particular ICF block panel or combination of blocks being used including straight, 90° corners, 45° corners and still other ICF block configurations. Other variations and modifications to the insert panel 10, the slots 34, and notches 42 and 44 are also contemplated.

Although the present insulation insert panel 10 is specifically designed to receive the Reward Wall iForm tie members as explained above, it is recognized and anticipated that one or both of the notches 42 and 44 can be sized and shaped to receive any projecting or lip portion associated with any of the known tie members used in the various ICF systems known in the industry. It is also recognized that the present insert panel 10 could be utilized with just one notch 42 when the corresponding tie members include just a single crossbar member 30 on each opposite end of the bridge member 22.

Still further, it is also recognized and anticipated that other tie members used in the ICF industry may include a wide variety of different types of projections, partial projections and/or extensions or lip portions associated with the transverse bridge members and that besides engaging a single notch associated with each respective slot 34, these projections and/or partial projections may likewise merely engage the slot 34. It is also recognized and anticipated that some of the various tie members used in the ICF industry may not include any type of projection or lip portion as described above. In this situation, the present slots 34 will merely receive the transverse bridge members associated with the tie members and no notches such as the notches 42 and 44 need be associated with each respective slot 34. In this particular situation, the width of each respective slot 34 can be dimensioned so as to slide over each respective transverse bridge member and sufficiently hold the entire insert panel 10 in its operative position when inserted within an ICF block. The overall length and height of each respective insert panel 10 will likewise help to stabilize and secure the insert panel in its operative position in a particular ICF block during the pouring of concrete. Other variations and modifications to the present insert panel 10 and the slots 34 are likewise contemplated.

Thus, there has been shown and described several embodiments of a novel insulation insert panel which is adapted for installation into an existing ICF block form, which insulation insert panel fulfills all of the objects and advantages sought therefor. Many changes, modifications, variations and other uses and applications of the present invention will, however, become apparent to those skilled in the art after considering this specification and the accompanying drawings. All such drawings, modifications, variations and other uses and applications which do not depart from the spirit and scope of the present invention are deemed to be covered by the present invention which is limited by the claims which follow.

The invention claimed is:

1. An insulation insert panel for use with an Insulated Concrete Form (ICF) block having a pair of opposed panel members positioned in spaced apart relationship to each other, a plurality of tie members extending transversely between said opposing ICF block panel members, each tie member including at least one transverse bridge member and at least one reinforcing crossbar member, the insulation insert panel comprising:

top, bottom and opposed end portions;

a plurality of spaced apart slots extending along the length thereof, each slot being positioned and located so as to mate with a tie member associated with the ICF block into which it is being inserted, each slot extending from the bottom edge portion of the insert panel to a terminal end portion thereof;

at least one notch located in the vicinity of the terminal end portion of each slot, said at least one notch being sized and shaped to receive the at least one reinforcing crossbar member associated with each tie member when the insert panel is fully positioned within the ICF block.

2. The insulation insert panel defined in claim 1 wherein each slot includes tapered opposed end portions adjacent the bottom end portion of said insert panel.

3. The insulation insert panel defined in claim 1 wherein the top end portion includes a longitudinally extending groove, and wherein the bottom end portion includes a longitudinally extending projection sized and shaped to be received by the groove associated with a similarly constructed insert panel.

4. The insulation insert panel defined in claim 1 wherein said panel is dimensioned lengthwise so as to extend along substantially the full length of at least one of the ICF block panel members.

5. The insulation insert panel defined in claim 1 wherein said panel is dimensioned heightwise so as to extend substantially along the full height of at least one of the ICF block panel members.

6. The insulation insert panel defined in claim 1 wherein the tie members associated with the ICF block include two reinforcing crossbar members associated with each transverse bridge member, and wherein each slot includes a pair of notches located in the vicinity of the terminal end portion of each said slot, said pair of notches being sized and shaped to receive the pair of reinforcing crossbar members associated with each tie member when the insert panel is fully positioned within the ICF block.

7. The insulation insert panel defined in claim 1 wherein said at least one transverse bridge member includes a plurality of rebar seats, and wherein each rebar seat includes a pair of adjacent fingers, the portion of each slot located between the at least one notch and its terminal end portion being dimensioned so as to receive at least some of the fingers associated with said rebar seats.

8. The insulation insert panel defined in claim 1 wherein each of said opposed ICF block panel members includes top and bottom edge portions, and cooperatively engageable means associated with the top and bottom edge portions of each such ICF panel member for attaching one ICF block to another similarly constructed ICF block.

9. The insulation insert panel defined in claim 1 wherein said panel is slidably positioned adjacent the inner surface of one of the pair of ICF block panel members.

10. The insulation insert panel defined in claim 1 wherein each insert panel has an R-value, said R-value being changeable based upon the type of material used to form said insert panel.

11. An insulation insert panel for use with an Insulated Concrete Form (ICF) block having a pair of opposed panel members positioned in spaced apart relationship to each other, a plurality of tie members extending transversely between said opposing ICF block panel members, each tie member including at least one transverse bridge member and at least a portion of a projecting member, the insulation insert panel comprising:

top, bottom and opposed end portions;

a plurality of spaced apart slots extending along the length thereof, each slot being positioned and located so as to mate with a tie member associated with the ICF block into which it is being inserted, each slot extending from the bottom edge portion of the insert panel to a terminal end portion thereof;

at least one notch located in the vicinity of the terminal end portion of each slot, said at least one notch being sized and shaped to receive the portion of a projecting member associated with each tie member when the insert panel is fully positioned within the ICF block.

12. The insulation insert panel defined in claim 11 wherein each slot includes tapered opposed end portions adjacent the bottom end portion of said insert panel.

13. The insulation insert panel defined in claim 11 wherein the top end portion includes a longitudinally extending groove, and wherein the bottom end portion includes a longitudinally extending projection sized and shaped to be received by the groove associated with a similarly constructed insert panel.

14. An insulation insert panel for use with an Insulated Concrete Form (ICF) block having a pair of opposed panel members positioned in spaced apart relationship to each other, a plurality of tie members extending transversely between said opposing ICF block panel members, each tie member including at least one transverse bridge member, the insulation insert panel comprising:

top, bottom and opposed end portions;

a plurality of spaced apart slots extending along the length thereof, each slot being positioned and located so as to mate with a tie member associated with the ICF block into which it is being inserted, each slot extending from the bottom edge portion of the insert panel to a terminal end portion thereof;

each slot being sized and shaped to receive the at least one transverse bridge member associated with each tie member when the insert panel is fully positioned within the ICF block.

15. The insulation insert panel defined in claim 14 wherein each slot includes tapered opposed end portions adjacent the bottom end portion of said insert panel.

16. The insulation insert panel defined in claim 14 wherein the top end portion includes a longitudinally extending groove, and wherein the bottom end portion includes a longitudinally extending projection sized and shaped to be received by the groove associated with a similarly constructed insert panel.

* * * * *